US007523832B2

(12) United States Patent
Kao

(10) Patent No.: US 7,523,832 B2
(45) Date of Patent: Apr. 28, 2009

(54) SUSPENSION DISPLAY RACK

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 0 days.

(21) Appl. No.: 11/976,223

(22) Filed: Oct. 23, 2007

(65) Prior Publication Data

US 2008/0041800 A1 Feb. 21, 2008

Related U.S. Application Data

(62) Division of application No. 11/185,000, filed on Jul. 20, 2005.

(51) Int. Cl.
*A47F 7/00* (2006.01)

(52) U.S. Cl. ..... 211/70.6; 206/376

(58) Field of Classification Search ..... 211/70.6, 211/94.01, 89.01, 60.1; 206/378, 376, 372, 206/373

See application file for complete search history.

(56) References Cited

U.S. PATENT DOCUMENTS 2,371,433 A * 3/1945 Davis ..... 211/70.6
4,209,098 A * 6/1980 Adams ..... 211/70.8
4,597,496 A * 7/1986 Kaplan ..... 211/70.6
5,937,340 A * 8/1999 Philippe et al. ..... 455/310
5,967,340 A * 10/1999 Kao ..... 211/70.6
6,092,656 A * 7/2000 Ernst ..... 206/378
6,095,329 A * 8/2000 Kao ..... 206/378
6,415,933 B1 * 7/2002 Kao ..... 211/70.6
6,450,338 B1 * 9/2002 Chen ..... 206/378
6,564,949 B1 * 5/2003 Saathoff ..... 211/70.6

* cited by examiner

*Primary Examiner*—David Purol
(74) *Attorney, Agent, or Firm*—Bacon & Thomas, PLLC

(57) ABSTRACT

A suspension display rack for tools has a rail and multiple sliding blocks. The rail has a back-strip, two longitudinal hooks joined to the back-strip and two grooves respectively defined at the joins between the hooks and the back-strip. The multiple sliding blocks each have a base, a seat extending from the base, and two bulbous rods formed at the base. The bulbous rods are respectively and matingly received in the grooves, whereby the hand tools can be hung on the sliding blocks which can transversely slide along the rail.

3 Claims, 14 Drawing Sheets

SUSPENSION DISPLAY RACK

The present invention is a divisional application claiming the benefit of U.S. patent application Ser. No. 11/185,000 filed on Jul. 20, 2005.

BACKGROUND OF THE INVENTION

1. Field of the Invention

The present invention relates to a suspension display rack for hand tools, and more particularly to a suspension display rack on which the hand tools can be arranged with a freely arranged distance between the tools.

2. Description of Related Art

A conventional tool display rack comprises a base, multiple seats respectively mounted on the base to abut or grip blades of screwdrivers, and a board mounted on the base to press against handles of the screwdrivers. Each seat has an abutting means and a handling means thereby cooperating with the board to securely fasten the screwdrivers to the rack.

However, with the fixed distance of the adjacent seats, each seat only retain one kind of the screwdriver such that the conventional suspension rack can not hang screwdrivers with different specifications. Furthermore, the seats are securely mounted on the base and can not be separated from the base such that the quantity of the seats can not be changed and therefore, the conventional suspension display rack is not versatile.

Therefore, the invention provides a suspension display rack for hand tools to mitigate or obviate the aforementioned problems.

SUMMARY OF THE INVENTION

The main objective of the present invention is to provide a suspension display rack for hand tools, on which the hand tools can be arranged and hung with free distances among the tools.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
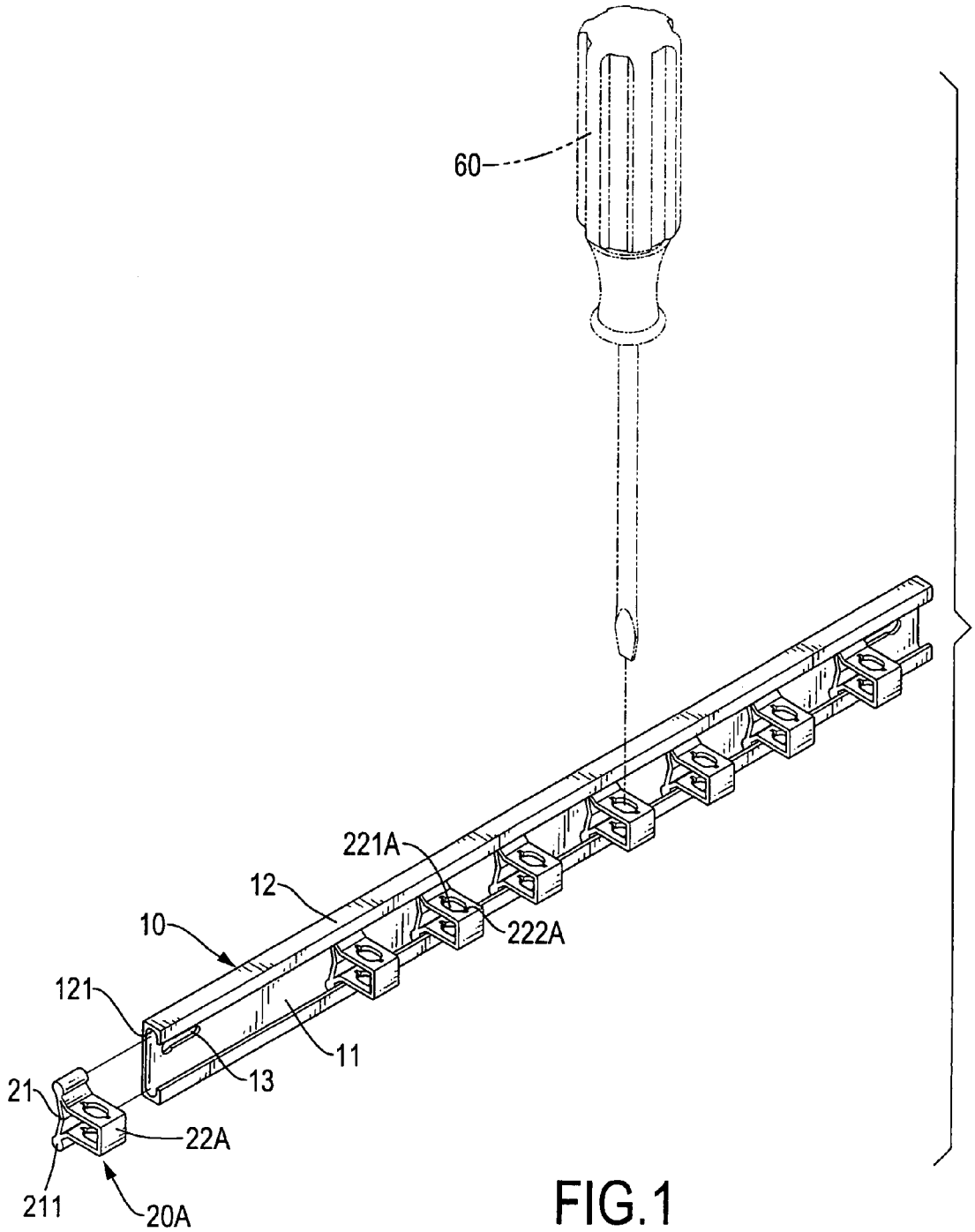
FIG. 1 is a perspective view of a first preferred embodiment of a suspension display rack for hand tools in accordance with the present invention in usage.
Figure 2:
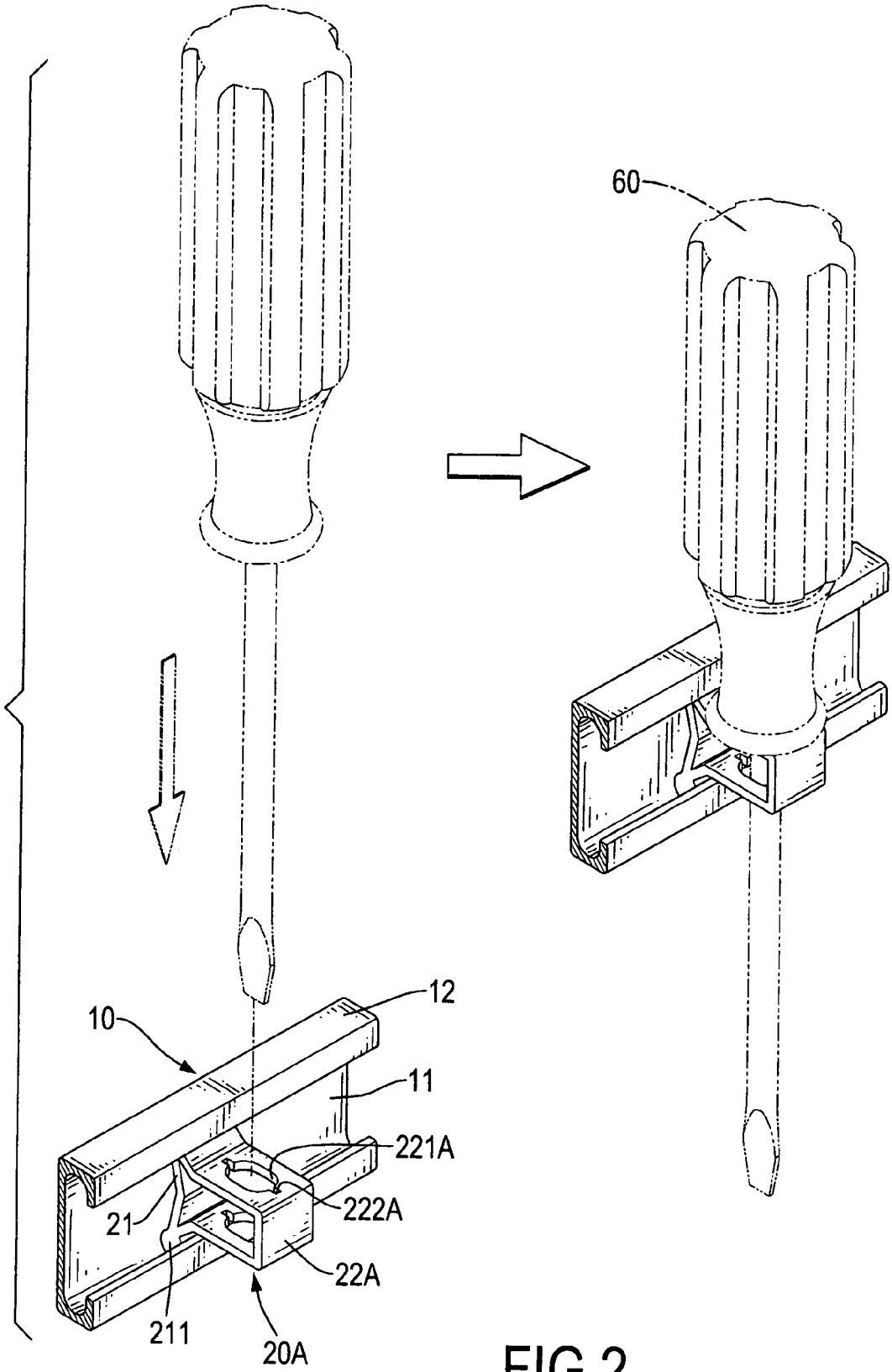
FIG. 2 is a schematic perspective view of the first preferred embodiment of the suspension display rack for hand tools in accordance with the present invention in usage.
Figure 3:
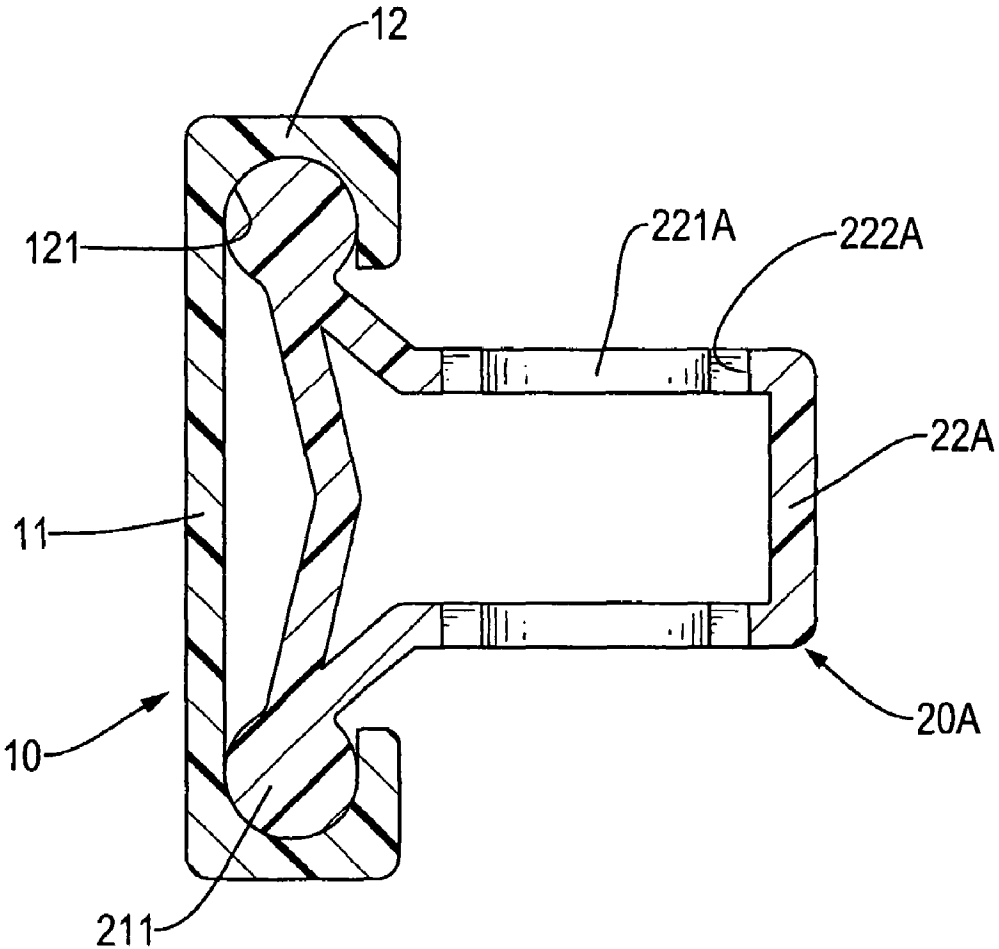
FIG. 3 is a sectional view of the first preferred embodiment of the suspension display rack for hand tools in accordance with the present invention.

With reference to FIGS. 1-4, a first preferred embodiment of a suspension display rack for hand tools comprises a rail (10) and multiple sliding blocks (20A).

The rail (10) is formed as a substantially C-like longitudinal back-strip (11) with two hooks (12) i.e., an upper hook and a lower hook symmetrical with the upper hook formed in a same direction on the back-strip (11). Two arcuate longitudinal grooves (121) are respectively defined at joints where the hooks (12) meet the back-strip (11). Two securing members (13) such as holes are respectively defined in opposed ends of the back-strip (11) whereby the rail (10) can be secured to a surface such as wall via two screws being respectively extended through the securing members (13). In the first preferred embodiment of the present invention, the securing members (13) are two oval holes and two screws can be respectively inserted into the oval holes to fasten the rail (10) to a surface.

The multiple sliding blocks (20A) each has a base (21) and a seat (22A) to position tools such as screwdrivers (60). The seat (22A) is formed as a substantially U-shaped body (20A) with two angled lateral plates joined by an upright wall at a distal end of the lateral plates. The base (21) is formed with distal ends of the lateral plates opposed to the upright wall whereby a central space is defined. The lateral plates are mirror images of the other and each defines a through hole (221A) having two opposed notches (222A) defined in a periphery of the through hole (221A). Each lateral plate has an angled end formed opposite to the upright wall. Distal tips of the angled ends are formed as bulbous rods (211) configured to mate with the arcuate grooves (121) of the rails (12). The base (21) is somewhat V-shaped such that a central portion is closer to the upright wall than the bulbous rods (211).

Figure 5:
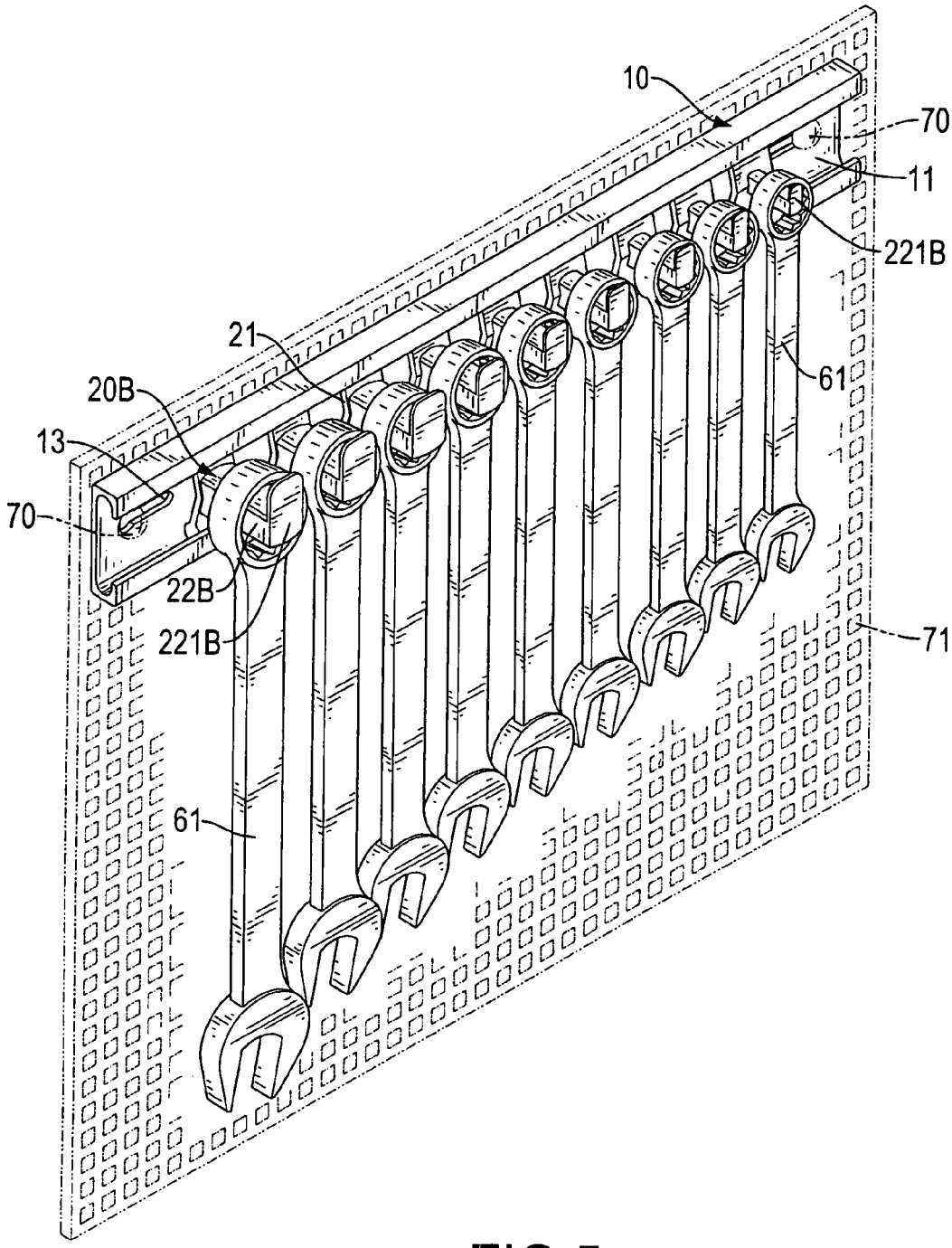
FIG. 5 is a perspective view of a second preferred embodiment of the suspension display rack for hand tools in accordance with the present invention in usage.
Figure 6:
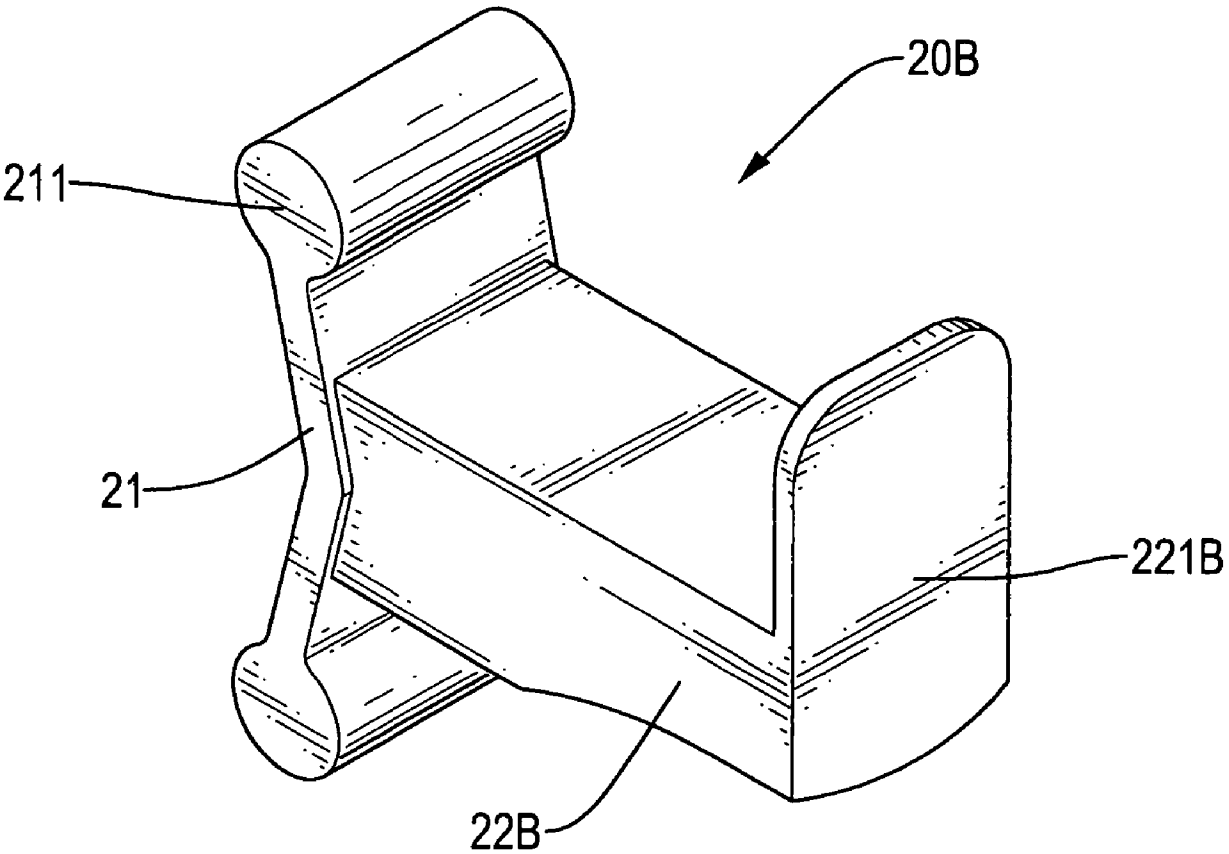
FIG. 6 is a perspective view of a seat of the second preferred embodiment of the suspension display rack for hand tools in accordance with the present invention.
Figure 7:
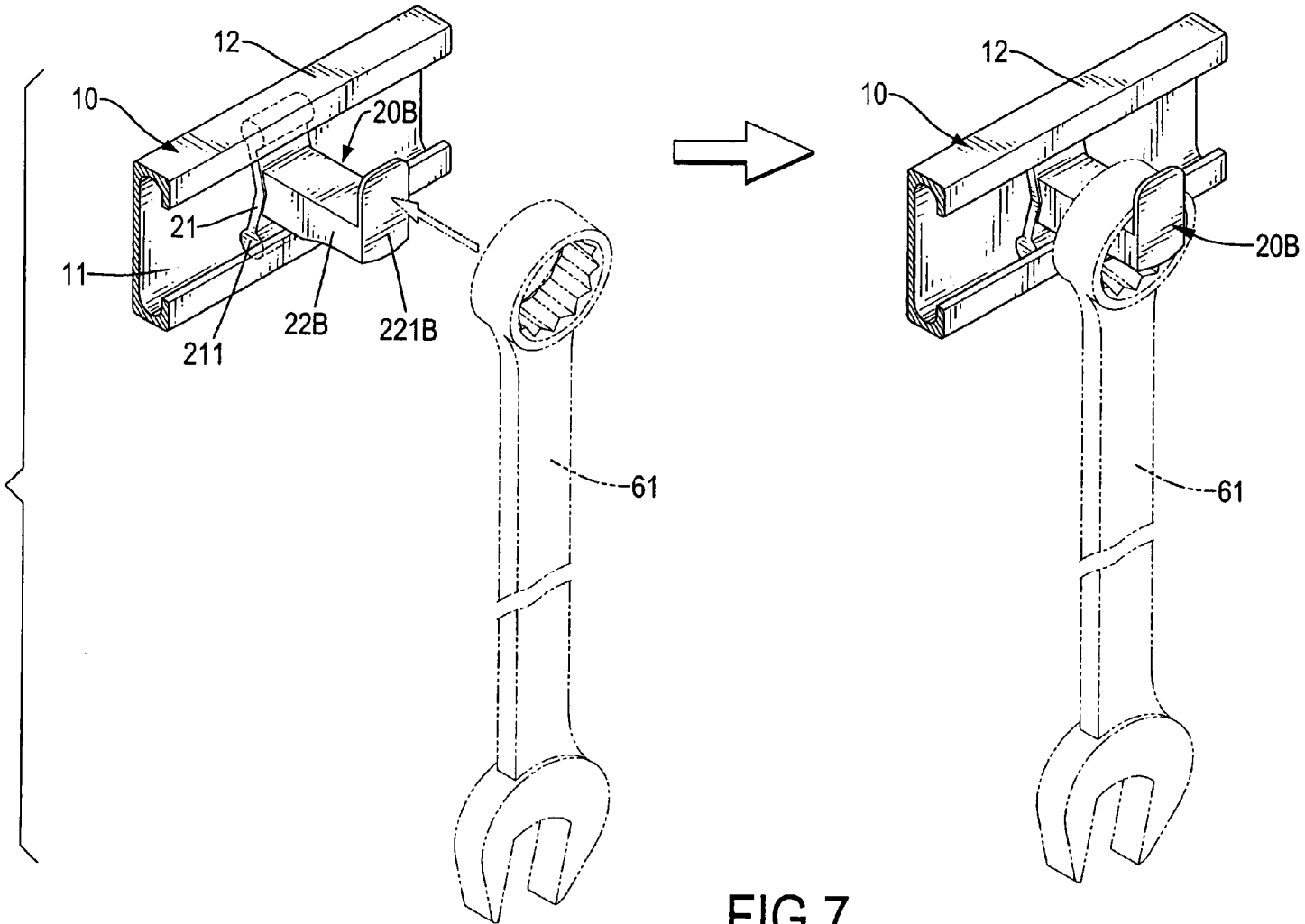
FIG. 7 is a schematic perspective view of the second preferred embodiment of the suspension display rack for hand tools in accordance with the present invention in usage.
Figure 8:
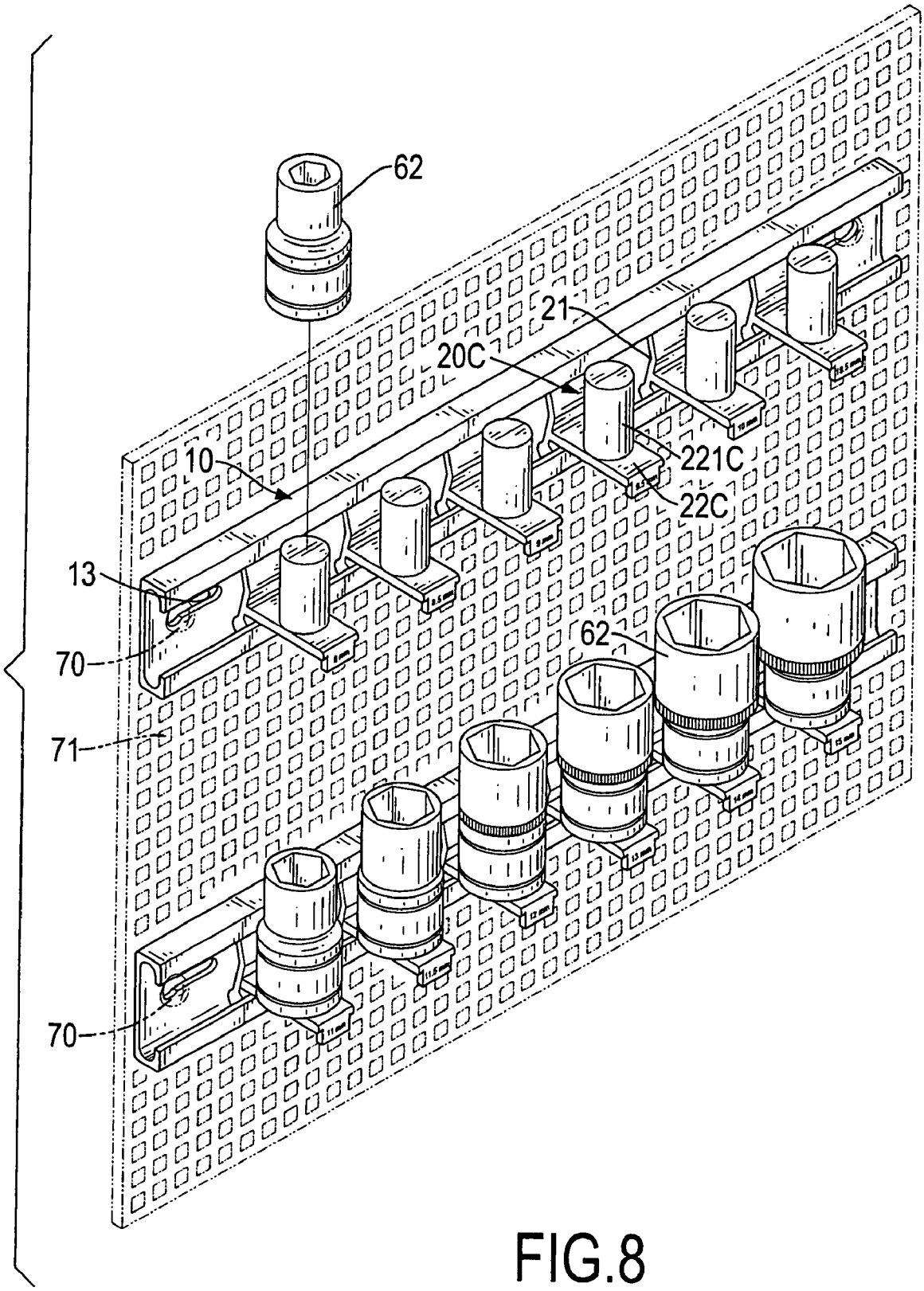
FIG. 8 is a schematic perspective view of a third preferred embodiment of the suspension display rack for hand tools in accordance with the present invention in usage.
Figure 9:
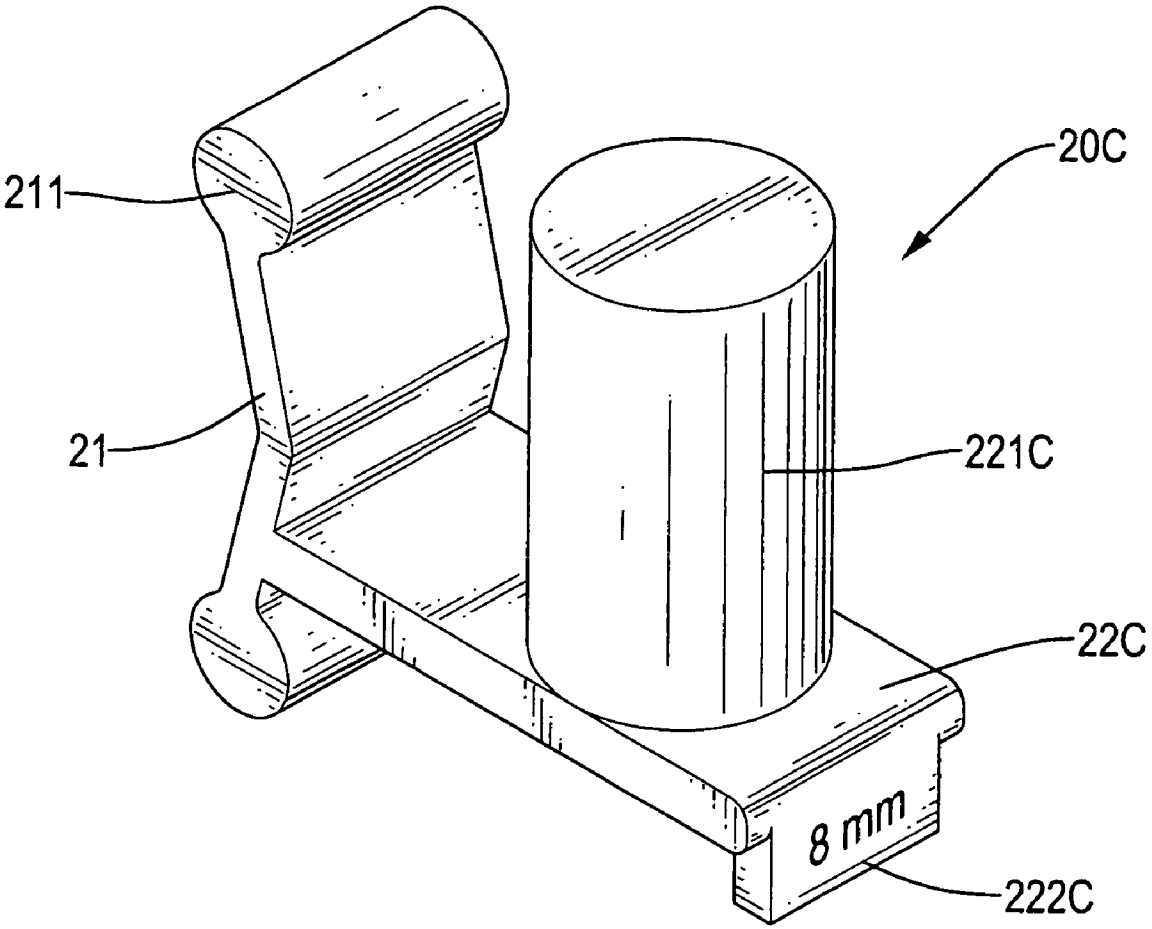
FIG. 9 is a perspective view of a seat of the third preferred embodiment of the suspension display rack for hand tools in accordance with the present invention.
Figure 10:
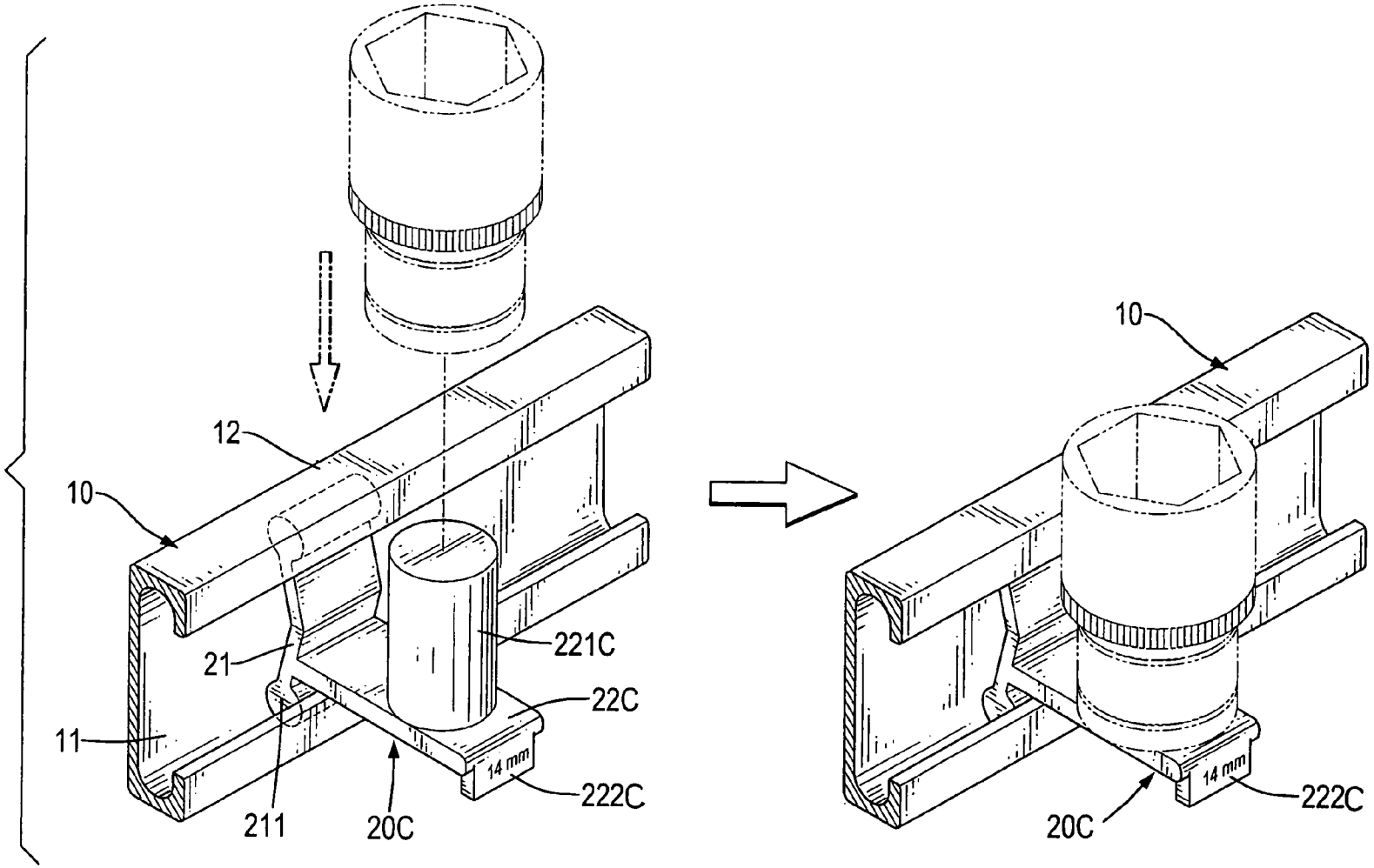
FIG. 10 is a schematic perspective view of the seat of the third preferred embodiment of the suspension display rack for hand tools in accordance with the present invention.

In the first preferred embodiment of the present invention, the spaced sliding blocks (20A) are slidably mounted on the rail (10) with free distance and the quantity of the sliding blocks (20A) can be increased or decreased. Furthermore, the seat (22A) can be solid instead of defining the central space yet the through hole (221A) is singular extending from the top of the seat (22A) to the bottom of the seat (22A). With reference to FIGS. 5-7, a second preferred embodiment of the suspension rack for hand tools is similar to the first preferred embodiment except that a sliding block (20B) has a seat (22B)

which extends from the base (21). A flange (221B) is upwardly formed at a free end of the seat (22B) thereby hooking each wrench (70) mounted on the seat (22B). With reference to FIGS. 8-10, a third preferred embodiment of the suspension rack is similar to the first preferred embodiment except that a sliding block (20C) has a seat (22C) which extends from the base (21), a barrel (221C) upwardly mounted on a center of the seat (22C), and a finger (222C) downwardly formed on a free end of the seat (22C). The finger (222C) can be used to display an identification label for a tool rested on the seat (22C).

Figure 11:
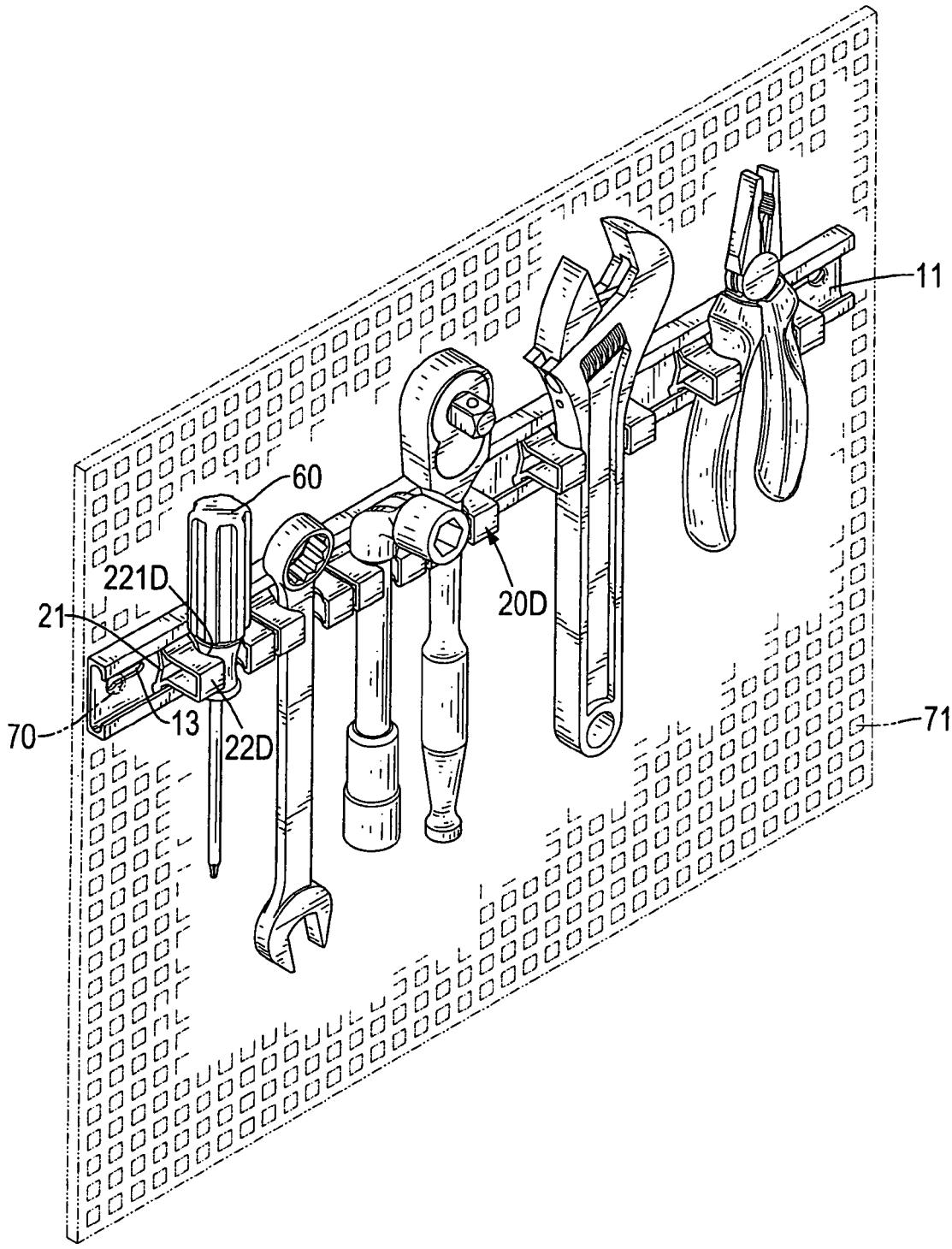
FIG. 11 is a perspective view of a fourth preferred embodiment of the suspension display rack for hand tools in accordance with the present invention in usage.
Figure 12:
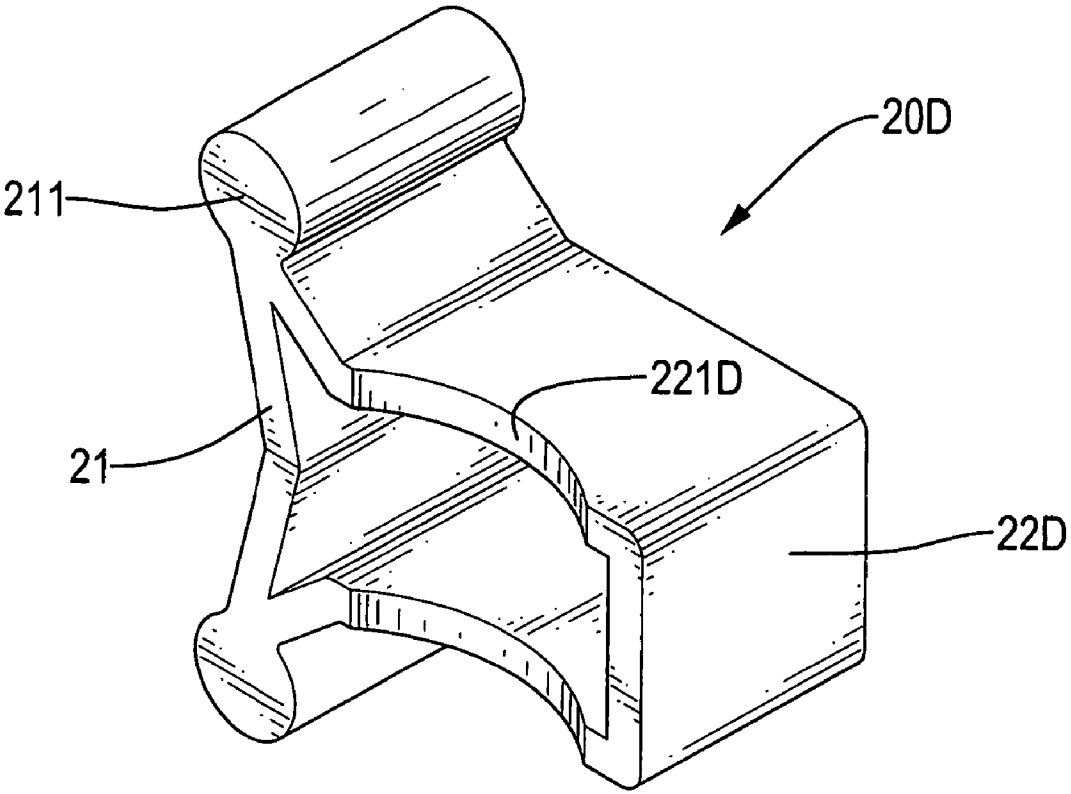
FIG. 12 is a perspective view of a seat of the fourth preferred embodiment of the suspension display rack for hand tools in accordance with the present invention.
Figure 13:
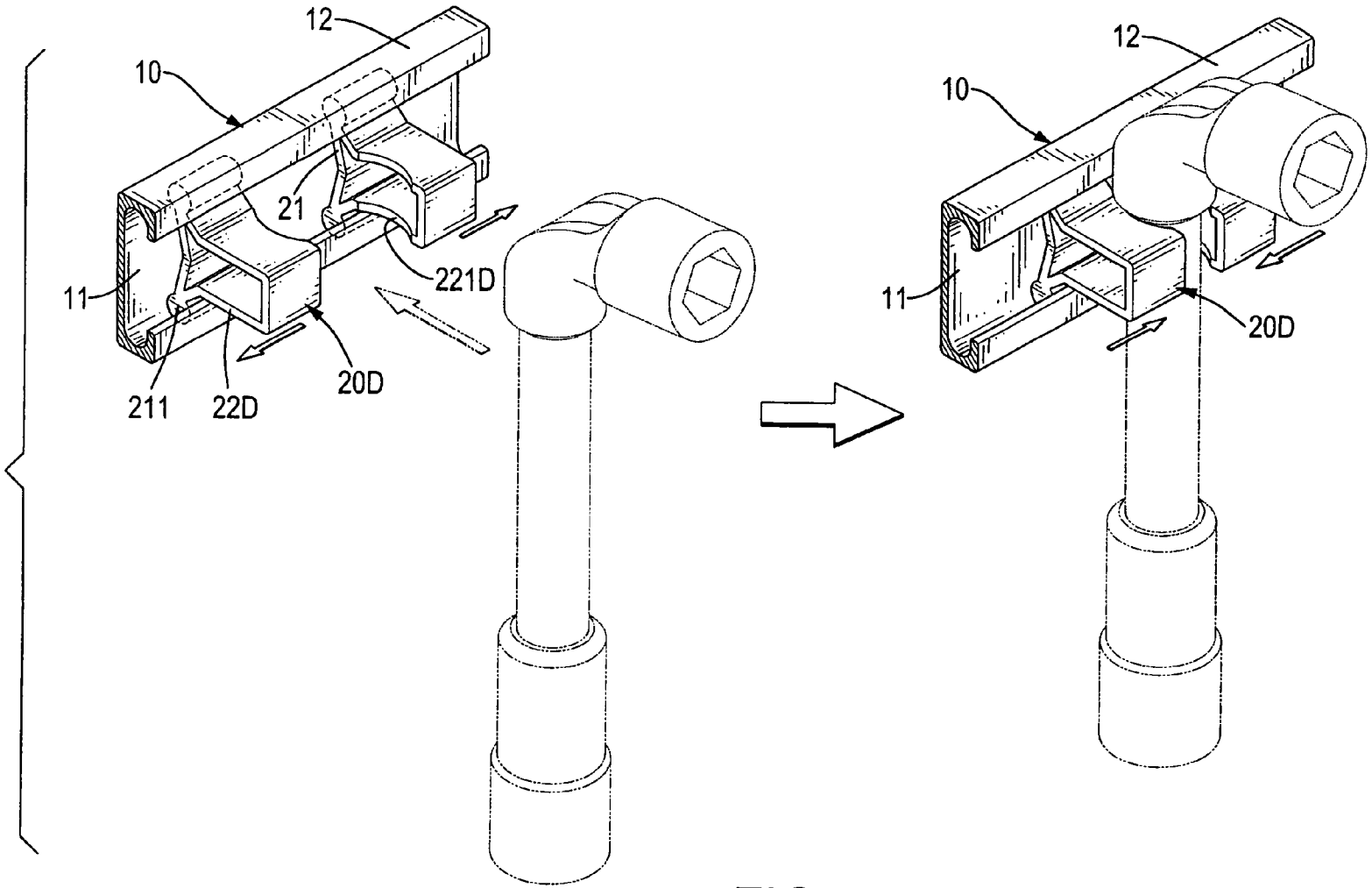
FIG. 13 is a schematic perspective view of the fourth preferred embodiment of the suspension display rack for hand tools in accordance with the present invention.

With reference to FIGS. 11-13, a fourth preferred embodiment of the suspension rack is similar to the first preferred embodiment except that a sliding block (20D) has a semi-shell seat (22D) and each two adjacent sliding blocks (20D) are used in co-operation as a single body. Two parallel arcuate cutouts (221D) are respectively defined in each semi-shell seat (22D) and the cutouts (221D) on one semi-shell seat (22D) are respectively faced with the cutouts (221D) on the corresponding other sliding block (20D) so that the hand tool can be gripped via the cutouts (221D).

With reference to FIG. 1, after a tip of the screwdriver (60) is inserted into the through holes (221A) and the notches (222A), the screwdriver (60) is rotated a certain amount in an axial direction so that each tip does not correspond to each notch (222A) to prevent the screwdriver from being easily pulled out of the through hole (221A), thus deterring shoplifters. Furthermore, the sliding blocks (20A) can slide along the rail (10) freely and therefore, the distance between each screwdriver (60) is not immovable.

With reference to FIGS. 5-7, 8-10, and 11-13, the second, the third and the fourth preferred embodiments of the suspension rack for hand tools are respectively similar to the first preferred embodiment, except that the second preferred embodiment is used for hanging wrenches (61), the third preferred embodiment is used for hanging sockets (62) and the fourth preferred embodiment is used for hanging the hand tools with one end larger than the other and the larger end being higher.

Figure 4:
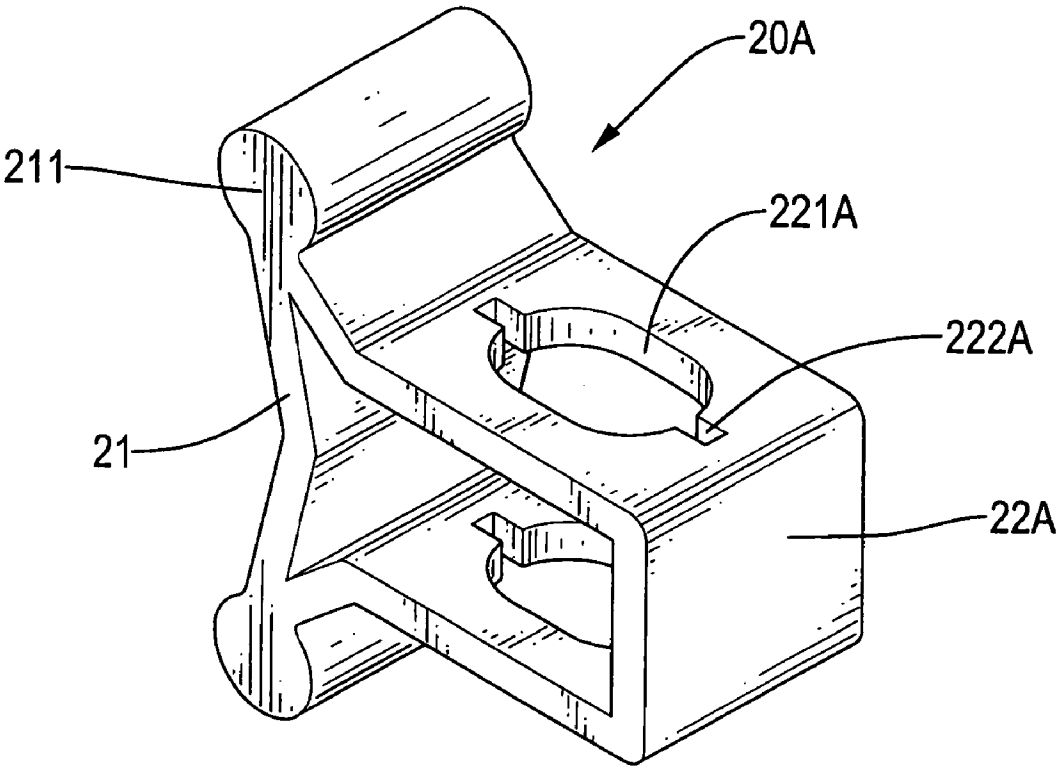
FIG. 4 is a perspective view of a seat of the first preferred embodiment of the suspension display rack for hand tools in accordance with the present invention.
Figure 14:
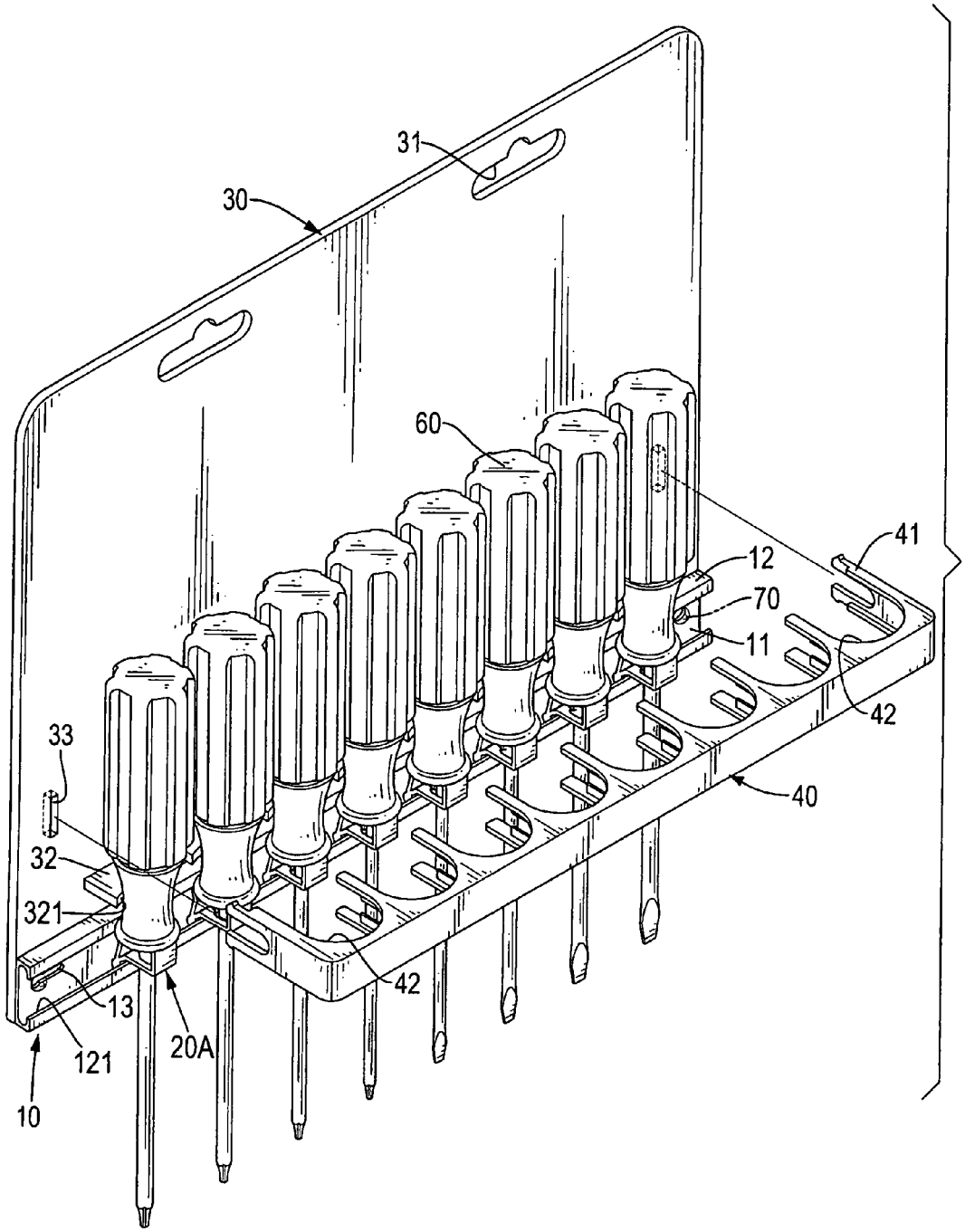
FIG. 14 is a perspective view of a suspension display rack for hand tools and showing an anti-theft feature in accordance with the present invention.

With reference to FIGS. 1, 4 and 14, the first preferred embodiment is provided on a sheet (30) to form a suspension wall rack for hand tools for protection against theft which is similar to the first preferred embodiment except for further comprising a sheet (30), multiple lateral fins (32), and a bridge-like clamp (40).

The length of the sheet (30) is the same as the length of the rail (10) and two openings (31) are defined in a top end of the sheet (30) so that the sheet (30) can be hung on a proper location. At least one fastener (70) is inserted into each oval hole and then into a bottom end of the sheet (30) and therefore, the rail (10) is securely mounted on the sheet (30). The fins (32) are perpendicular to the sheet (30) and are above the rail (10), and an arcuate cut-out (321) is defined in each fin (32) and opposed to the sheet (30). The quantity of the fins (32) is the same as that of the sliding blocks (20A) and two upright slots (33) are respectively defined in two opposed ends of the sheet (30) and above the fins (32).

Multiple even-spaced U-like recesses (42) are respectively defined in the bridge-like board (40), and two fork-like members (41) are respectively formed in two opposed ends of the bridge-like board (40) and detachably mated with the slots (33) so that the bridge-like board (40) can be securely mounted on the sheet (30) and the U-like recesses (42) are mounted above the fins (32).

When the suspension rack for hand tools is used for hanging the screwdrivers (60), the screwdrivers (60) are respectively downwardly inserted into the notches (222A) and the through holes (221A). Furthermore, each U-like recess (42) has a periphery that is pressed against the handle and a middle portion of each screwdriver (60). The outer circumference of each U-like recess is smaller than that of the handle, and inclined against the arcuate cut out (321) so that the screwdriver (60) can not be upwardly pulled out of the through hole (221A) thus achieving a theft-proof effect.

When the bridge-like board (40) is separated from the slots (33) and the tip of each screwdriver (60) aligns with the through hole (221A), the screwdrivers (60) can be taken out of the through hole (221A). Furthermore, when the fasteners (70) are respectively taken out of the oval holes, the rail (10) can be hung on the proper location for use due to the oval holes being mated with the fasteners, and screwdrivers (60) can be slidably mounted along the rail (10) due to the sliding blocks (20A) for flexible usage.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An anti-theft suspension display rack for tools comprising:

a rail having a back-strip and two hooks extending perpendicularly from a same face of the back-strip and at respective upper and lower edges of the back-strip, and two securing members formed respectively at opposed ends of the back-strip;

multiple sliding blocks each having a generally V-shaped base and two bulbous tips formed at spaced distal tips of the base and respectively inserted into the hooks, and a seat extending from the base having a through hole defined therethrough, whereby tools can be fastened to the sliding blocks which can transversely slide along the rail;

a sheet having at least one opening defined in a top end thereof, and the rail detachably mounted on a bottom end of the sheet;

multiple evenly-spaced fins horizontally provided on and perpendicular to the sheet and above the rail, a quantity of the fins being the same as the quantity of the sliding blocks, and two slots respectively defined in two opposed ends of the sheet and above the fins;

a bridge-like board mounted above the fins and having two fork-like members respectively formed in two opposed ends thereof, multiple even-spaced U-like recesses defined in the bridge-like board and corresponding to the fins, whereby the fork-like members can be inserted into the slots to fasten the rails to the sheet; and wherein two opposed notches are defined in the circumference of and in communication with each through hole.

2. The theft-proof suspension display rack for tools as claimed in claim 1, wherein each securing member is an oval hole and at least one fastener is inserted into the oval hole whereby the rail is mounted on the sheet.

3. The theft-proof suspension display rack for tools as claimed in claim 1, wherein two arcuate grooves are respectively defined in the back-strip.

* * * * *